US006527273B1

(12) United States Patent
Dixson

(10) Patent No.: US 6,527,273 B1
(45) Date of Patent: Mar. 4, 2003

(54) ROAD CONSTRUCTION BOARD GAME

(76) Inventor: Ralph Dixson, P.O. Box 1263, Trabelers Rest, SC (US) 29690

( * ) Notice: Subject to any disclaimer, the term of this patent is extended or adjusted under 35 U.S.C. 154(b) by 0 days.

(21) Appl. No.: 09/858,440

(22) Filed: May 17, 2001

(51) Int. Cl.[7] ..... A63F 3/00
(52) U.S. Cl. ..... 273/254; 273/248
(58) Field of Search ..... 273/236, 243, 273/251, 252, 254, 250, 287, 248

(56) References Cited

U.S. PATENT DOCUMENTS

| | | | | | |
|---|---|---|---|---|---|
| 940,855 | A | * | 11/1909 | Clemens | 273/252 |
| 1,476,175 | A | * | 12/1923 | Perkins | 273/252 |
| 3,638,946 | A | * | 2/1972 | Bain | 273/254 |
| 4,049,276 | A | * | 9/1977 | Hole | 273/252 |
| 4,067,579 | A | * | 1/1978 | Boofer | 273/254 |
| 4,078,803 | A | * | 3/1978 | Te | |
| 4,095,800 | A | | 6/1978 | Konsolas | |
| 4,411,432 | A | * | 10/1983 | Stevens | 273/251 |
| 4,643,429 | A | * | 2/1987 | Crandon et al. | 273/251 |
| 4,643,430 | A | | 2/1987 | D'Aloia | |
| 4,733,870 | A | | 3/1988 | Rinehart | |
| 4,958,837 | A | * | 9/1990 | Russell | 273/252 |
| 4,961,582 | A | | 10/1990 | Van Lysel | |
| 5,405,140 | A | | 4/1995 | Terlinden et al. | |
| 5,660,390 | A | * | 8/1997 | Ginzburg et al. | 273/257 |
| 6,139,016 | A | * | 10/2000 | Plato | 273/242 |

* cited by examiner

*Primary Examiner*—Benjamin H. Layno
*Assistant Examiner*—V K Mendiratta
(74) *Attorney, Agent, or Firm*—Patent & Trade Mark Services; Thomas Zack; Joseph H. McGlynn

(57) ABSTRACT

A game that has a map of the contiguous U.S. with the players trying to construct roads at random locations between cities. Four cities on the map are selected at random, the first to construct roads between the cities wins the game using selected cards and overcoming other obstacles.

7 Claims, 2 Drawing Sheets

ROAD CONSTRUCTION BOARD GAME

BACKGROUND OF THE INVENTION

This invention relates to a board game which uses a map of the United States of America (U.S.) in which the players try to construct roads between cities.

Games, including board games, that employ maps are well known and have been used for many years. For example, in one earlier game there is a map of selected countries and a path placed on the board. The first player to traverses the path wins. Another prior art game discloses a map of the U.S. and simulates the operation of a trucking company.

In another game with a map fictitious continental regions and players are disclosed with the players earning points through the use of game cards. Another game discloses a map showing areas of Europe and players earning points by moving from city to city.

Still another game discloses a map of the U.S. and simulates a family vacation.

DESCRIPTION OF THE PRIOR ART

Games that employ maps are disclosed in the known in the prior art. For example, U.S. Pat. No. 4,095,800 to Konsolas discloses a map of selected countries and a path placed on the board. The first player to traverses the path wins.

U.S. Pat. No. 4,643,430 to D'Aloia discloses a map of the U.S. and simulates the operation of a trucking company.

U.S. Pat. No. 4,733,870 to Rinehart discloses a map with fictitious continental regions and players with the players earning points through the use of game cards.

U.S. Pat. No. 4,961,582 to Van Lysel discloses a game with a map showing areas of Europe and players earning points by moving from city to city.

U.S. Pat. No. 5,405,140 to Terlinden et al. discloses a map of the U.S. and simulates a family vacation.

In the present invention is a game which uses a map of the U.S. with the players trying to construct roads at random locations all as will be detailed in the specification that follows hereafter.

SUMMARY OF THE INVENTION

This invention relates to a game which uses a map of the U.S. with the players trying to construct roads at random locations. Four cities on the map are selected at random, the first to construct roads between their cities wins the game using selected cards and overcoming other obstacles.

It is the primary object of the present invention to provide for an improved board game having a map of the U.S. and selected cities.

Another object is to provide for such a game in which each player is randomly assigned cities using the first deck of cards while a second card deck provides for action and frustruction directions to help or delay the winning of the game according to the rules.

These and other objects and advantages of the present invention will become apparent to readers from a consideration of the ensuing description and the accompanying drawings.

DESCRIPTION OF THE PREFERRED EMBODIMENT

Figure 1:
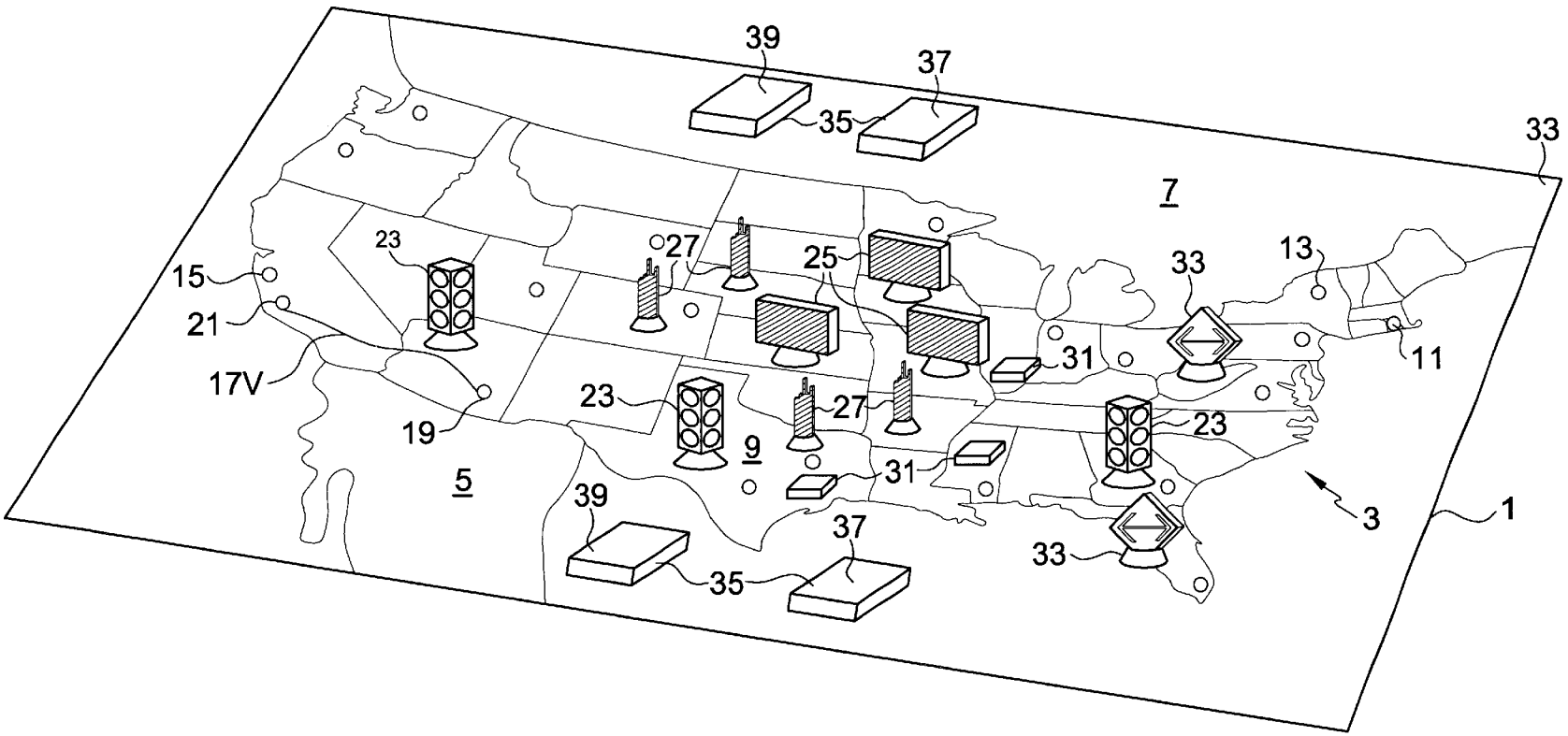
FIG. 1 is a perspective view of the board game of the present invention showing the map of the U.S. with some playing pieces placed on the board.
Figure 2:
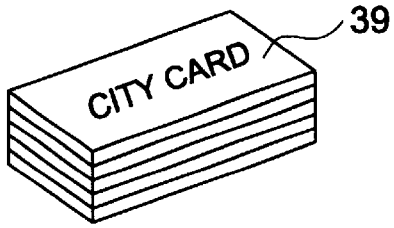
FIGS. 2–8 are views of the game board pieces used with the FIG. 1 game board.
Figure 3:
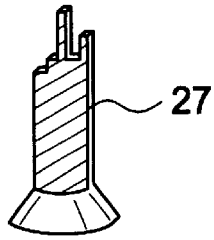
Figure 4:
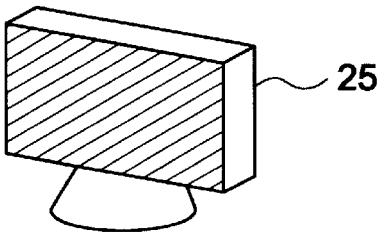
Figure 5:
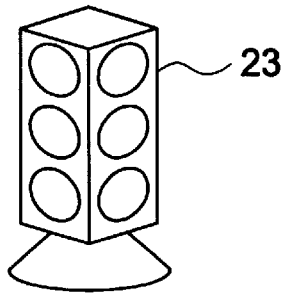

FIG. 1 is a perspective view of the board game 1 of the present invention showing a map 3 of the states for the contiguous U.S. with some playing pieces placed on the board. The board 1 is rectangular in shape and may be foldable for storage or transport purposes. The adjacent portions of the countries of Mexico 5 and Canada 7 are also shown on the board. Within the map 3 each of the forty eight states are outlined in different colors with roads traversing the states to some selected cities located in that or an adjacent state. All of the depicted states are represent in size and shape in relation to each other with Texas 9 being the largest shown and Rhode Island 11 the smallest. In one embodiment 32 distinct cities are shown on map 3 at their locations within the states in which actually located, for example, New York City 13 and Los Angeles 15. A large O may be used to represent the city space and a rectangle (v) for road space on the map. As an example, one road between two cities is marked with both a 17 and a V . Interconnecting each of the distinct cities are roads 17 with road space, like Interstate Highway 10 from Phoenix, AZ 19 to San Diego, Calif. 21. This is but one example used to mark both the location of a road 17 and the space for the road V. Each of the road connected cities selected is marked by a O.

In addition to the shown states, selected cities, connecting roadways, and other well known geographical representations, like the great lakes, rivers, Gulf of Mexico and Oceans, the map 3 may have certain playing pieces and/or markers placed on its surface. As described in more detail with respect to FIGS. 2–8, the playing pieces consist of two decks of cards and the playing markers consists of City Markers, Road Closed Markers, Intersection Markers, Player tiles (five different colors) and Detour Markers. On the map there are: three Intersection Markers 23 shown standing upright on the map, three Road Closed Markers 25, three City Markers 27, three Player tiles 31 of three different colors, and two Detour Markers 33. Playing cards 35 are also shown in FIG. 1. A City Peg , not shown, may also be used.

Figure 6:
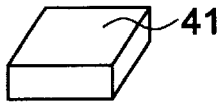
Figure 7:
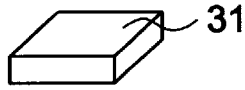
Figure 8:
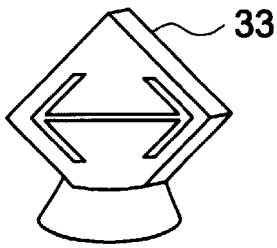

FIGS. 2–8 are views of the game board pieces used with the FIG. 1 game board. The previous mentioned playing pieces and markers are shown in greater detail including the intersection Marker 23 (FIG. 5) with different colored signal lights on four sides of the marker, the Road Closed Marker 25(FIG. 4), a City Marker 27 (FIG. 3), one of five individual colored Player tiles 31 (FIG. 7), the Detour Marker 33 (FIG. 8) and a safe passage tile 41 (FIG. 6). Another possible playing piece, The City Peg, is not shown. The two decks of playing cards designated as playing pieces 35 shown in FIG. 1 may be broken down into two sub decks marked Frustruction 37 and City Card 39. There are four distinct different sets of color markers used with their two sub decks . In the preferred embodiment, there are twenty four City Markers (4 of each different color), 18 City Markers pegs (3 of each different color), 240 road construction tiles, 6 Intersection Markers (traffic signals), 4 Detour Marker signs shaped like an orange diamond with black arrows pointing in different direction on the face, 4 Road Closed Marker signs shaped like a rectangle with alternating black and yellow stripes, 13 Safe Passage tiles 41 colored white, 4 neutral City Markers having white circular stacks, 104 cards in all in the deck marked FRUSTRUCTION, 37 and 32 cards in the another deck 39 marked with the names of the 32 preselected cities.

In use each of the four players choose a respective different color. The Detour Marker signs, Road Closed Marker signs, neutral City Markers and Safe Passage white tile 41 (one subset of the tiles 31) are placed on the flat surface of board 1 in their respective places. The city deck of cards 39 is shuffled and 4 cards are dealt face up one for each of four players. These four cities represent the cities the roads are to be constructed to connect. The remainder of the city deck of cards is placed face down on the game board 1. Players then place their City Markers 27 on the four cities dealt and return the cards to the bottom of the city deck of cards 39. The other deck of cards 37 (see FIG. 1) is shuffled and dealt with 3 cards face down to each player such that each player is limited to only seeing the cards dealt to that player. The remainder of the cards in deck 37 is divided into two piles and placed face down on the board. The youngest player goes first with others following in clockwise order.

After drawing a card from the deck 37, a player plays one of the four cards they hold. For example, if you hold a card marked "Play Immediately" this card must be played and followed, otherwise it is the card of your choice. If you hold more than one "Play Immediately" card, play the one of your choice and then the second "Play Immediately" card on your next turn. Once the card is played and instructions followed your turn is over.

The Frustruction deck of cards contains cards with a variety of cards with different indicia on their face side. One is the Mileage Card. When using this card a ratio of one road construction tile for 100 miles on the map 3, a corresponding number of these tiles are place on the road space of the game board map. If you choose, you may connect your road construction tiles to cities or tiles of other players already on the game board in order to connect to your cities. Road construction tiles may not be placed on a space indicated as a city space.

Another card in the deck 37 has indicia indicating Remove Mileage Card. If this card is selected, the player can remove the corresponding number of road construction tiles from any road space on the game board, e.g., 1 tile=100 miles. You many not remove a safe passage tile from the game board once they are played.

The Intersection Card is also in the deck 37. When selected a player may place this card on any vacant City space only. An Intersection or City Marker must be on a City space in order for the road construction tiles to be connected through that city. Only 6 intersections may be placed on the game board at any one time.

A Remove An Intersection Card is also in the card deck 37. When selected the player may remove the Intersection Card of their choice from the game board.

The Detour Card is in deck 37. This card detours traffic and is represented by the detour marker 33. When this card is selected, the marker is placed on the game board on any road space. Detours may not be placed on top of road tiles. Road construction tiles are not connected as long as the Detour remains on that road between the road tiles. The Detour marker must be removed and a road construction tile put on the road for the tiles to be connected. Only 4 Detours may be placed on the game board at any one time. Detours may not be placed on a City space. There is a Remove a Detour Card in deck 37 which allows the selector player to remove any Detour of their choice from the game board.

Another card in deck 37 is the Road Closed Card. The Road Closed card allows the selector to place a Road Closed Marker 25 on any road space on the game board. Road Closed signs may not be placed on the top of road tiles. Once placed on the board the Road Closed Marker 25 remains until the game is over.

Still another card in deck 37 is the Safe Passage Card. This selected card is represented by a white tile 41. This tile may be placed on any road space where there is not a road tile. Safe Passage tiles 41 may not be placed on a City space. Safe Passage tiles cannot be removed by other players and count the same as road construction tiles. Safe passage tiles may be used by any players during the game as with regular road tiles. Safe Passage tile must connect to one another when played. If all of the Safe Passage tiles 41 indicated on the card drawn cannot be used during that turn they are forfeited.

When the Exchange a City Card is drawn from deck 37, a player will switch 2City Markers as instructed on the card drawn. If a Move a City Card is selected from the same deck, the player will move a City maker to a vacant city as instructed on the card drawn. Cities occupied by an Intersection are consider vacant for this purpose.

The Add a City Card is also in deck 37. When selected a player must add another city to connect to (insert the colored peg into a Neutral City marker and place on the board). This player now has has an additional city to connect to through the game. If the city drawn is currently occupied by another player simply drawn another City card from deck 39 and resume play.

The Give a City Card in deck 37, when drawn, allows the player to add another city to any opponent he or she chooses (i.e., insert the colored City peg 29 into a Neutral City marker and place on the board). That selected opponent player now has an additional city to connect to throughout the game.

The Double Play Card in the Frustruction deck of cards 37 allows the player to draw an additional card and do what is indicated on the card twice. If it is not possible to complete all of the instructions on the card drawn, the player completes what is possible and play moves to the next player. For example, if the card instructs you to place 2 Detour Markers and only one such marker is left to place.

In order to win a player must be the first to connect all of your City Markers. If two or more players connect all of their cities at the same time, clear the board. Each player that "tied" remains in the game. The cards in deck 37 are reshuffled and dealt three to each remaining player. The players left are each dealt two City cards from the top of the City Card deck 39 to connect and play resume as usual until there is a winner.

The present game teaches Geography, Topography, Strategy, Advance Planning, and dealing with sudden and unexpected adversity that can impact carefully planned logistics and strategy. If desired magnets can be used to hold the markers to the game board when traveling or semi-precious jewels with precious metals could also be used for the markers. The game board could be made of any appropriate material such as durable cardboard, paper or plastic.

Although the preferred embodiment of the present invention and the method of using the same has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A game comprising:

a board having a map representative of the contiguous United States of America with roads connecting selected cities designated on the map;

a first deck of cards with the names of the selected cities shown on the map of the board with one card for each city, said cards being chosen by the players to indicated selected cities;

a second deck of cards with indicia indicating instructions to a player; and markers associated with a plurality of the instructions on the second deck of cards, said markers being movable on the board to select locations on the roads connecting the selected cities, said markers being placed on the map of the board when a card from the second deck is drawn that indicates the placement, some of said placed markers comprising road construction markers whereby the player who first constructs a road by placing road construction markers between the cities selected based on the cards chosen from the first deck of card is considered the winner.

2. The game as claimed in claim 1, wherein said markers include detour markers and road closed markers, said detour markers comprising arrows on a triangle shaped sign and said road closed markers comprising alternating different colored strips on a rectangular shaped sign.

3. The game as claimed in claim 2, wherein said markers include intersection markers, said intersecting markers being shaped to represent traffic signals with different colored representations of signal lights on at least two sides of the marker.

4. The game as claimed in claim 3, wherein said markers include tiles of the same color with each tile representing a given number of miles on the map.

5. The game as claimed in claim 4, wherein markers include a safe passage tile of a given color placeable on the map to indicate safe passage on the road.

6. The game as claimed in claim 5, wherein said markers include a city marker with an associated card in the second deck instructing the player to switch city markers.

7. The game as claimed in claim 5, wherein said markers include neutral city markers used in conjunction with different colored pegs.

* * * * *